US006354666B1

(12) United States Patent
Atkins et al.

(10) Patent No.: US 6,354,666 B1
(45) Date of Patent: Mar. 12, 2002

(54) AUTOMATED PROCESS FOR SEWING OF MOP HEAD INTERMEDIATE AND PRODUCT THEREOF

(75) Inventors: Douglas M. Atkins, LaGrange; William H. Pace, Newnan; Vernon C. Brown, LaGrange, all of GA (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/709,841

(22) Filed: Nov. 10, 2000

(51) Int. Cl.[7] ..... A46D 3/00
(52) U.S. Cl. ..... 300/21; 300/16
(58) Field of Search ..... 300/16, 21

(56) References Cited

U.S. PATENT DOCUMENTS 3,449,784 A * 6/1969 Moss ..... 300/21
3,822,435 A * 7/1974 Moss ..... 300/21
3,962,743 A * 6/1976 Moss ..... 300/21
5,522,648 A * 6/1996 Wilen ..... 300/21

* cited by examiner

*Primary Examiner*—Randall E. Chin
(74) *Attorney, Agent, or Firm*—Terry T. Moyer; Charlotte C. Wilson

(57) ABSTRACT

The invention relates to an automated process for sewing a mop head intermediate and a finished mop head. Specifically, the inventive process uses overlapping panels of fabric to create pockets into which any of a variety of mop handle assemblies may be inserted. These fabric strips are sewn longitudinally onto a tufted strip, after which the ends of each mop head unit are sewn to create pockets. A border strip of fringe is then secured around the perimeter of the mop head. The automated process results in increased production consistency, improved fabric utilization, and decreased production times.

14 Claims, 3 Drawing Sheets

AUTOMATED PROCESS FOR SEWING OF MOP HEAD INTERMEDIATE AND PRODUCT THEREOF

TECHNICAL FIELD

This disclosure relates to an automated process for sewing a mop head intermediate and a finished mop head and the products thereof. Specifically, the present process uses a number of overlapping panels of fabric to create pockets into which any of a variety of mop handle assemblies may be inserted. The automated process results in increased production consistency, improved fabric utilization, and decreased production times.

BACKGROUND

Conventional mops are formed from string and are secured to the mop handle in a permanent manner. Because this configuration presented some problems (such as laundering of the mop head and the relative lack of durability of the mop head as compared to the mop handle), mop producers began to produce mop heads and handle assemblies separately from one another. As a result, attachment means were developed to secure the mop head to the mop handle for cleaning purposes, while also allowing cleaning or replacement of the mop head itself. Some of these attachment means include fabric ties, hook and loop fasteners (i.e., Velcro®), snaps, and the like.

The separate mop handle assemblies themselves are often T-shaped, with the vertical part of the T comprising the handle portion held by the user and the horizontal part of the T comprising a cross-member that is attached to the mop head. There are primarily three types of mop handle assemblies: a break-away assembly, in which the cross-member is separate from the mop handle and collapses into a V-shape to facilitate attachment to the mop head; a spring-loaded assembly, which has an attached handle and a cross-member that collapses into a V-shape; and an "envelope"-style assembly, in which the cross-member is removed from the mop handle prior to attachment to the mop head. In the envelope-style assembly, the mop head is attached to the cross-member and the cross-member is then attached to the mop handle.

The present process is directed specifically to fringe mops. These mop heads have a floor side comprised of a tufted (or "fringed") substrate and a face side to which a mop handle is attached. In most circumstances, fringe mop heads have fringe around the perimeter of the mop head and, in some cases, several pockets on the face side (that is, the side viewed by the user during the mopping process). The pockets provide means to attach a mop handle assembly to the mop head, by providing a space into which the respective ends of the mop handle's cross-member may be inserted. In many instances (as described above), the cross-member itself is collapsible to facilitate insertion into the mop head's pockets.

While these pockets are functionally useful, their creation has been problematic for mop head manufacturers. The manufacturer is forced to cut each piece of fabric used to create the pockets into appropriately sized individual units. Each individual fabric unit must be placed onto a predetermined location on the face side of the mop head. Each individual fabric unit must be sewn to the mop head. Finally, each mop head must be finished by sewing a strip of fringe to the perimeter of the mop head.

The center panel must be tacked to the mop head to prevent a mop handle from passing between the panel and the mop head. This is particularly a problem with the envelope-style handle assemblies discussed above. If the mop handle's cross-member passes beneath the center panel, then the attachment means used to connect the cross-member and the vertical member of the mop handle assembly is obstructed, rendering the mop handle assembly unusable without re-inserting the mop handle into the mop head.

The present process addresses several shortcomings of the conventional method. First, the present process automates the cutting and the sewing processes, producing greater consistency in manufacturing and in the final product. Secondly, the present process also reduces the amount of fabric that must be used and the amount of time that is required to produce a sewn mop head.

SUMMARY

The present process automates the cutting and sewing of pockets to the face side of a mop head, thereby creating a mop head intermediate product to which a perimeter strip of fringe may be attached to produce a finished mop head. The finished mop head is suitable for use with break-away, spring-loaded, and envelope-style handle assemblies. By automating the cutting and sewing of the mop head pockets, fabric and time utilization are decreased on a per-unit basis. In addition, greater consistency between individual mop head units is also created.

DETAILED DESCRIPTION

The term "wet mop" refers to an instrument that has an absorbent material attached to a shaft (i.e., a mop handle) that is designed for cleaning with a liquid solution or designed to absorb a liquid on contact. A sponge mop is one example of such an instrument. The term "dust mop" refers to an instrument designed for removing dust or other solid debris from a floor. The fringe mop of the present invention is one example of such a dust mop.

The term "mop head," as referred to herein, shall refer to that part of a dust mop that contacts and cleans the floor during use. The mop head has a face side and a floor side, the face side being viewed by the user during use and the floor side being in contact with the floor. The face side has a number of pockets that are capable of receiving the respective ends of a mop handle assembly therein, and the floor side is tufted to resemble fringe. The perimeter of the finished mop head is bounded by a strip of fringe.

The term "mop head intermediate" refers to a mop head to which the perimeter strip of fringe has not been added.

The term "mop handle assembly" refers to a T-shaped instrument, with the vertical part of the T comprising the handle portion held by the user and the horizontal part of the T comprising a cross-member that is in contact with the mop head. The present process produces mop heads that are compatible for use with break-away, spring-loaded, and envelope-style mop handle assemblies.

Figure 1:
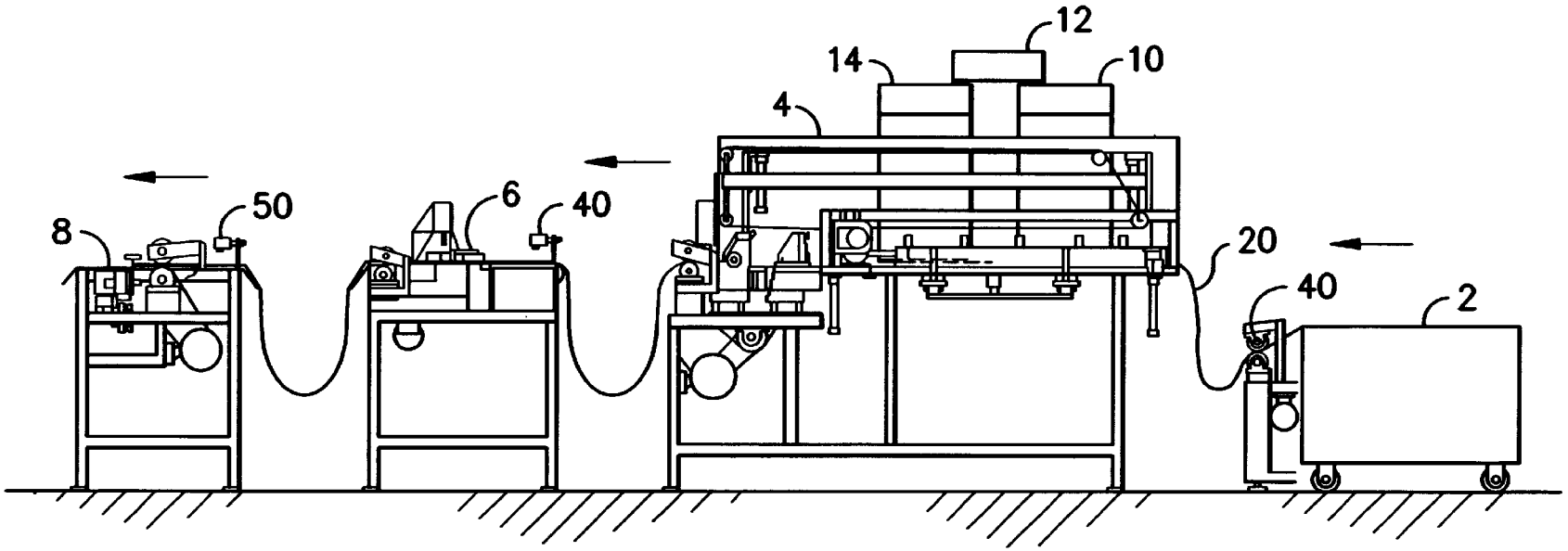
FIG. 1 is a schematic side-view representation of the automated cutting and sewing operations described herein.

Turning now to FIG. 1, a continuous strip 20 of tufted substrate is conveyed through a number of stations 2, 4, 6, and 8. Tufted strip 20 has a fringed floor side, which forms the cleaning surface of the finished mop head, and a face side to which pockets are sewn to facilitate attachment of the finished mop head to a mop handle assembly. Tufted strip 20 is preferably comprised either of 100% nylon or 100% cotton, although polyester or other fiber materials could also be used. In accordance with one embodiment, the nylon strip is dyed prior to entering station 2. The preferred fringe length is about 1.5 inches, although the automated sewing process of the present invention could apply to other fringe lengths as well.

In station 2, tufted strip 20 is unwound and threaded through a guide mechanism 40 with the fringed side positioned downward. Because tufted strip 20 is a continuous fringed strip, tufted strip 20 will create a plurality of individual mop head intermediates 58 (and subsequently, finished mop heads 60).

In station 4, as shown in FIG. 1, three rolls of fabric 10, 12, and 14 are used to created fabric panels 30, 32, and 34 that are positioned over tufted strip 20. This process is automated based on settings that reflect the desired mop dimensions. Fabric panels 30, 32, and 34 are positioned in fully overlapping relationship to tufted strip 20 and in slightly overlapping relationship with one another. Such panel-to-panel overlap is typically on the order of 0.25 inches, although each panel could lap more area of an adjacent panel if so desired. Center panel 32 is consistently positioned beneath panels 30 and 34. Fabric panels 30, 32, and 34 are then cut from fabric rolls 10, 12, and 14 with a rotary blade or other cutting means known in the industry.

The longitudinal and lateral dimensions of fabric panels 30, 32, and 34 are identified in relation to the longitudinal and lateral dimensions of mop head 60. As might be expected, the longitudinal and lateral dimensions of fabric panels 30, 32, and 34 are dependent upon the desired finished dimensions of mop head 60. Additionally, the longitudinal dimension of fabric panel 32, which creates the center pocket, is dependent upon the average measured size of a mop handle's cross-member. The lateral dimension of panels 30, 32, and 34 is substantially equivalent to lateral dimension of mop head 60. Representative examples of such longitudinal dimensions are provided in Table 1 below, although the present process is equally well-suited for mop heads having other dimensions.

TABLE 1

| | Longitudinal Dimensions | | |
|---|---|---|---|
| Mop head | Panel 30 | Panel 32 | Panel 34 |
| 14.5 inches | 4.75 inches | 5 inches | 6.25 inches |
| 21.5 inches | 5.875 inches | 8.875 inches | 7.75 inches |
| 23.5 inches | 6.5 inches | 10 inches | 7 inches |
| 25.5 inches | 7 inches | 10 inches | 9.5 inches |

The dimensions of panel 34, as listed in Table 1, include the entire dimension of panel 34 as it is positioned on tufted strip 20. When lateral cuts are made in tufted strip 20 to produce individual units 56, panel 34 is divided into sub-panels. The smaller sub-panel 34' is identically sized regardless of the dimension of mop head 60. One suitable longitudinal dimension for sub-panel 34' has been found to be about 3.5 inches. Sub-panel 34' needs to be long enough to prevent a mop handle assembly from disengaging mop head 60, but not so long as to create difficulty in folding sub-panel 34' over the mop handle assembly (as in the case of envelope-style mop handles).

Fabric panels 30, 32, and 34 are sewn longitudinally across the length of tufted strip 20. Before being conveyed into station 6, tufted strip 20 is stamped in two places along panels 32 and 30 with water-soluble ink. The ink markings are removed during a subsequent washing process, and, therefore, do not remain on finished mop head 60. One marking is placed on panel 32 in what will be the center of mop head 60, while the second marking is placed on panel 30 at a position laterally different than that of the center mark. The importance of the markings will become evident as described below.

In station 6, tufted strip 20 is conveyed beneath a fiber optic reader 40 that is positioned in alignment with the center marking on panel 32. Because of this alignment, fiber optic reader 40 is prevented from producing a false command based on a reading of the second marking. Fiber optic reader 40 controls the sewing process in the following way: optic reader 40 detects the first marking, tufted strip 20 is moved forward a predetermined distance based on desired mop dimensions, and center panel 32 is then bartacked laterally across the center of tufted strip 20.

The term "bartack" refers to a stitch pattern that is used to produce a small area of stitches used to secure two fabric panels to one another. The bartack stitch used in one embodiment of the present invention has dimensions of approximately 0.5 inches long and 0.125 inches wide. The purpose of the bartack stitch is to prevent the cross-member of a mop handle assembly from slipping beneath center panel 32. If this were to occur, then the mop handle cross-member and mop handle could not be attached to one another, without the inconvenience of reinserting the mop handle cross-member into mop head 60 for a second time.

In station 8, a second fiber optic reader 50 is positioned in alignment with the second marking on panel 30. After passing beneath optic reader 50, tufted strip 20 is conveyed a predetermined distance, again based on desired mop dimensions, and is cut to the desired mop length. Cutting may be accomplished by any means known in the industry including rotary cutters. Once cut, a tufted strip unit 56 is created (see FIG. 2). Tufted strip unit 56 is a pre-cursor to mop head intermediate 58, which is, in turn, a pre-cursor to mop head 60.

Figure 2:
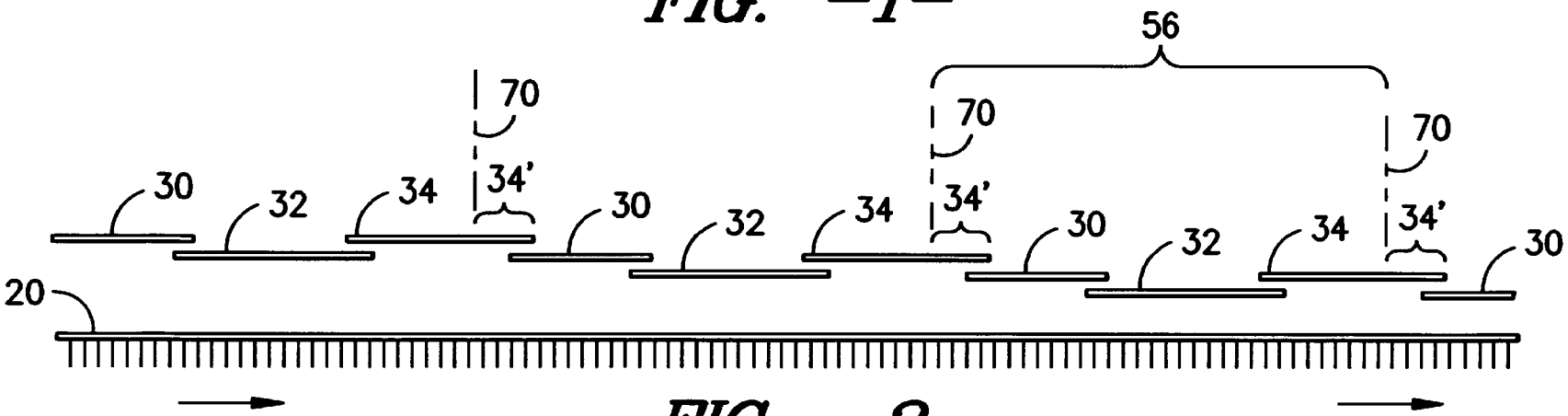
FIG. 2 is a schematic side-view representation of a plurality of fabric panels utilized in the present process to form pockets on the face side of a mop head.

One feature of the present process is the ability to continuously form a plurality of mop head intermediates 58. This ability is due to the overlapping of fabric panels 30, 32, and 34 onto tufted strip 20, as illustrated in FIG. 2. Center panel 32 is typically positioned first onto tufted strip 20, thereby causing panel 32 to be overlapped by panels 30 and 34. As the series of panels is repeated, panel 34 overlaps panel 30.

The overlapping position of panels 30, 32, and 34 does not coincide with the cutting of a length of tufted strip unit 56 (that is, tufted strip units 56 are not separated from one another along the edges of panels 30 or 34). Rather, the cutting of tufted strip unit 56 is through panel 34, creating two sub-panels, the smaller of which is indicated in FIGS. 2 through 5 as 34'. Cut lines 70 are indicated in FIG. 2 by dashed vertical lines.

Figure 3:
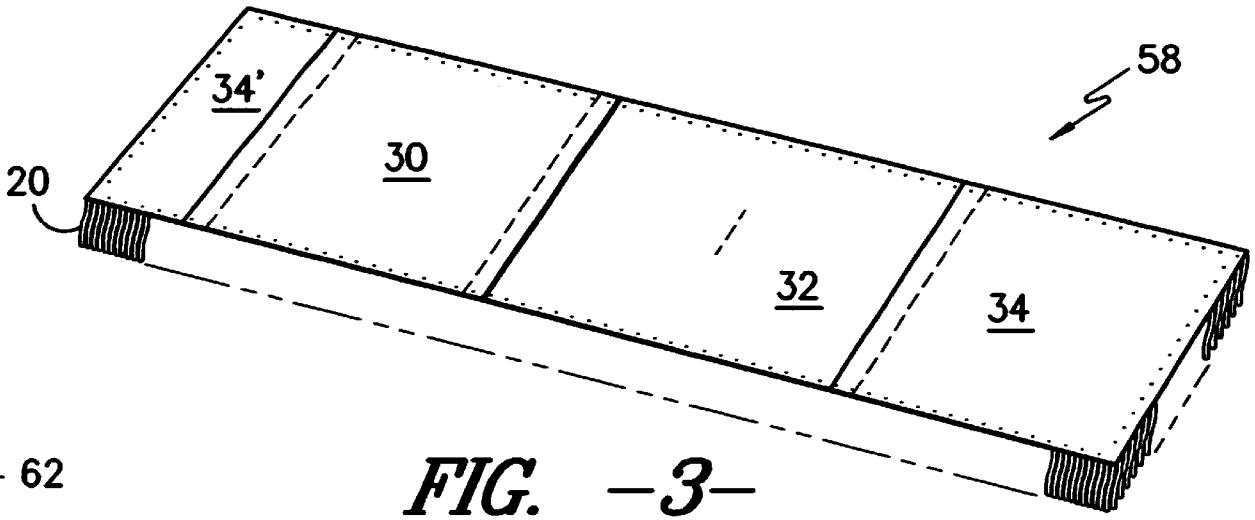
FIG. 3 is a top perspective view of the mop head intermediate produced by the present process.

The lateral (cut) ends of tufted strip unit 56 are then sewn to complete the pockets from sub-panels 34 and 34' into which a mop head assembly will be inserted. The creation of functional pockets at either end of tufted strip unit 56 produces a mop head intermediate 58, as shown in FIG. 3. Mop head intermediate 58 lacks the perimeter strip of fringe used to create finished mop head 60.

Figure 4:
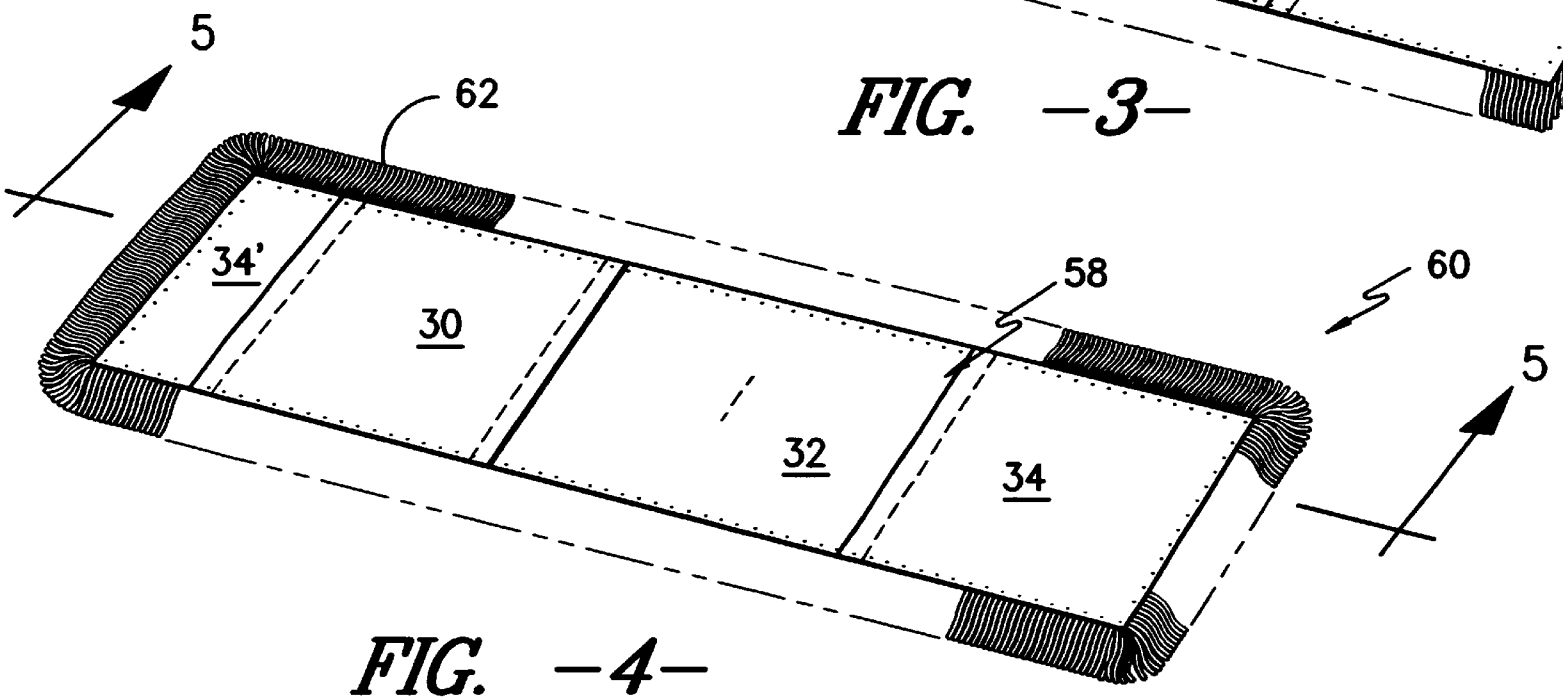
FIG. 4 is a top perspective view of the finished mop head produced by the present process.

A final step in the completion of a finished mop head unit 60, is the sewing of a strip of fringe 62 around the perimeter of mop head intermediate 58. Perimeter fringe 62 improves the cleaning efficiency of mop head 60. FIG. 4 shows a complete mop head 60. Fringe 62 is sewn around the perimeter of mop head intermediate 58. The composition and length of fringe 62 is in accordance with the fringe that comprises tufted strip 20 (for example, for a dyed nylon mop head, the fringe is made of dyed nylon and has a length of about 1.5 inches).

Figure 5:
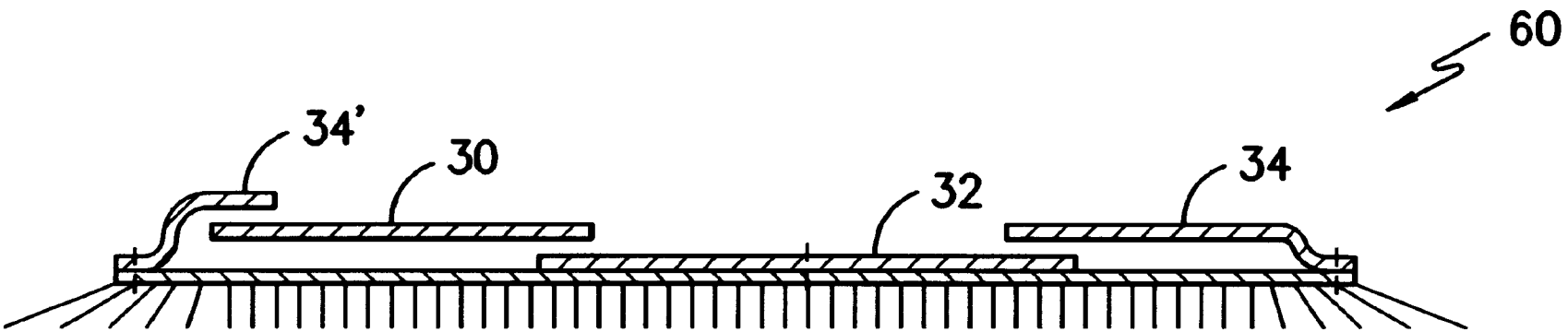
FIG. 5 is a cross-sectional view of the finished mop head of FIG. 4, as taken along Line 5—5.

FIG. 5 shows a cross-sectional view of mop head 60 as taken along line 5—5 of FIG. 4. This view indicates the relative position of each of panels 30 and 32 and sub-panels 34 and 34'. Panel 32 is positioned in the center area of mop head 60 and is overlapped by panel 30 and sub-panel 34. Sub-panel 34' results from the cutting of panel 34 as previously described. FIG. 5 illustrates that sub-panels 34 and 34' are attached to either end of mop head 60 to create pockets into which a mop handle assembly is inserted and in which the mop handle assembly is held.

To attach mop head 60 to a break-away or spring-loaded mop handle assembly, the cross-member is collapsed, and the respective ends of the cross-member are positioned into the pockets created by sub-panels 34 and 34'. The cross-member is positioned above panel 32 and beneath panel 30 and sub-panels 34 and 34'. This positioning allows the collapsible cross-member to be attached to the mop handle without difficulty. It also secures the mop handle assembly during use. For these mop handle styles, it would be possible to attach a mop head that uses only two fabric panels, where the second panel is cut and sewn to create fabric pockets.

For envelope-style mop handle assemblies, the cross-member is removed from the mop handle and is pushed into mop head 60. The cross-member is inserted between sub-panel 34' and panel 30 and then is pushed under panel 30, over panel 32, and then into the pocket created by sub-panel 34. Sub-panel 34' is returned to its original position (overlapping panel 30) to secure the cross-member and prevent it from sliding out of its position in mop head 60. As with the previously mentioned mop handle styles, the cross-member can then be attached to the mop handle. For this style of mop handle assembly, the three-panel mop head of the present process is required.

By automating a process previously performed manually, the present invention provides a more efficient method of producing mop heads. Less time and less fabric are required. There is greater consistency between individual mop head units. For these reasons, the present process is believed to represent an advancement of the prior art.

What is claimed is:

1. An automated process for creating a plurality of individual mop head intermediate units, said process comprising:

(a) providing a tufted textile strip, said tufted strip having a face side and a floor side, said face side being substantially flat and said floor side being tufted, said tufted strip further having a lateral dimension and a longitudinal dimension, said longitudinal dimension being greater than said lateral dimension;

(b) overlapping the face side of said tufted strip with a series of textile panels, said series comprising at least two panels, each of said textile panels having a lateral dimension that is substantially equal to the lateral dimension of said tufted strip, the longitudinal edges of said panels positioned in coincident relation to the longitudinal edges of said tufted strip;

(c) attaching said textile panels to said tufted strip along the longitudinal edges of said tufted strip;

(d) laterally cutting said tufted strip into individual tufted strip units in such a way as to divide one of said overlapping textile panels in said series into two sub-panels; and (e) attaching a first sub-panel along one lateral edge of said tufted strip unit to form a first pocket and a second sub-panel along the opposite lateral end of said tufted strip unit to form a second pocket, said pockets being capable of receiving a mop handle assembly.

2. The process of claim 1 wherein said series of textile panels comprises a first textile panel, a second textile panel, and a third textile panel, said third textile panel being divided in step (d) into two sub-panels.

3. The process of claim 2 wherein textiles from each of three respective rolls is transversely fed across the face side of said tufted strip and longitudinally cut to form said first textile panel, said second textile panel, and said third textile panel.

4. The process of claim 2 wherein said second textile panel is secured to said tufted strip by bartacking.

5. The process of claim 2 wherein, after step (b), said second textile panel and said third textile panel are each marked with a water-soluble ink, said second panel being marked in the center thereof, and said third panel being marked a position laterally different than that of the marking on said second panel.

6. The process of claim 5 wherein a first fiber optic reader scans the marking on said second panel, thereby causing said second panel to be bartacked to said tufted strip.

7. The process of claim 5 wherein a second fiber optic reader scans the marking on said third panel, thereby causing said third panel to be cut laterally into two sub-panels.

8. A mop head intermediate produced by the process of claim 1.

9. An automated process for continuously creating a plurality of individual mop head units, said process comprising:

(a) providing a plurality of mop head intermediate units; and (b) attaching a strip of fringe around the perimeter of each of said units.

10. An individual mop head unit produced by the process of claim 9.

11. The mop head unit of claim 10 wherein said tufted strip and said textile panels are comprised of the same fiber.

12. The mop head unit of claim 11 wherein said tufted strip and said textile panels are comprised of nylon.

13. The mop head unit of claim 11 wherein said tufted strip and said textile panels are comprised of cotton.

14. The mop head unit of claim 11 wherein said tufted strip and said textile panels are comprised of polyester.

* * * * *